US010465135B2

(12) United States Patent
Nikiforuk

(10) Patent No.: US 10,465,135 B2
(45) Date of Patent: Nov. 5, 2019

(54) HYDROCARBON PROCESSING

(71) Applicant: Colin Nikiforuk, Calgary (CA)

(72) Inventor: Colin Nikiforuk, Calgary (CA)

( * ) Notice: Subject to any disclaimer, the term of this patent is extended or adjusted under 35 U.S.C. 154(b) by 473 days.

(21) Appl. No.: 13/896,979

(22) Filed: May 17, 2013

(65) Prior Publication Data

US 2013/0306520 A1 Nov. 21, 2013

Related U.S. Application Data

(60) Provisional application No. 61/648,750, filed on May 18, 2012.

(51) Int. Cl.

| | |
|---|---|
| ***F17C 7/00*** | (2006.01) |
| ***C10G 5/00*** | (2006.01) |
| ***C10L 3/10*** | (2006.01) |
| ***C10G 31/06*** | (2006.01) |

(52) U.S. Cl.
CPC ..... *C10L 3/101* (2013.01); *C10G 5/00* (2013.01); *C10G 31/06* (2013.01); *C10L 3/106* (2013.01); *F17C 7/00* (2013.01)

(58) Field of Classification Search
CPC ..... C10L 3/101; F17C 7/00; C10G 5/00
See application file for complete search history.

(56) References Cited

U.S. PATENT DOCUMENTS

| | | | | |
|---|---|---|---|---|
| 4,139,019 | A * | 2/1979 | Bresie | F17C 5/002 137/351 |
| 4,446,804 | A | 5/1984 | Kristiansen et al. | |
| 5,351,756 | A * | 10/1994 | Minkkinen | E21B 37/06 166/267 |
| 6,516,631 | B1 | 2/2003 | Trebble | |

FOREIGN PATENT DOCUMENTS

| | | | | |
|---|---|---|---|---|
| CA | 2679108 | | 9/2008 | |
| CA | 2679108 | A1 * | 9/2008 | F17C 5/02 |
| CA | 2679108 | A1 * | 9/2008 | F17C 5/02 |
| GB | 2335406 | | 9/2009 | |

OTHER PUBLICATIONS

Moshfeghian, Dr. Mahmood; Variation of Properties in the Dense Phase Region; Part 2—Natural Gas; Tip of the Month; John M. Campbell & Co.; 2010; Internet: www.jmcampbell.com.

* cited by examiner

*Primary Examiner* — Randy Boyer
(74) *Attorney, Agent, or Firm* — Bennett Jones LLP

(57) ABSTRACT

A method for processing raw natural gas for storage and transport in a storage vessel at a storage pressure greater than the raw natural gas dense phase pressure, which includes the steps of receiving the raw natural gas in a flow path at an inlet pressure greater than the storage pressure; if necessary, dehydrating the raw natural gas; and continuously releasing the dehydrated raw natural gas from the flow path at a release pressure and a release temperature into a storage vessel until the pressure of the dehydrated raw natural gas in the storage vessel reaches the storage pressure, avoiding the solidification of any impurities in the raw natural gas. Also, a method of processing crude oil having dissolved raw natural gas for storage and transport in a storage vessel at a storage pressure greater than the bubble point pressure, includes the steps of receiving the crude oil at an inlet pressure greater than the storage pressure, and loading the crude oil into the storage vessel until the crude oil reaches the storage pressure, without separating any dissolved raw natural gas from the crude oil. Alternatively, raw natural gas is separated from the crude oil, and compressed to at least the storage pressure, dehydrating the raw natural gas, and recombining the dehydrated raw natural gas with the crude oil prior to loading into the storage vessel, avoiding the solidification of any impurities in the raw natural gas.

8 Claims, 3 Drawing Sheets

HYDROCARBON PROCESSING

CROSS REFERENCE TO RELATED APPLICATIONS

This application claims the priority benefit of U.S. Provisional Application No. 61/648,750 filed on May 18, 2012 entitled "Hydrocarbon Processing", the contents of which are incorporated herein by reference.

FIELD OF THE INVENTION

The present invention relates to methods for processing raw natural gas or crude oil with associated raw natural gas, for storage in a storage vessel, which may be used for transport and offloading.

BACKGROUND OF THE INVENTION

Natural gas production sites and crude oil production sites producing associated natural gas may be situated at great distances from markets where the natural gas or crude oil and associated gas are ultimately consumed. Therefore, the natural gas or crude oil and associated natural gas must be treated and processed prior to being transported from the production site to the market where it can be offloaded.

One solution is to use a pipeline network. However, this presupposes that an existing pipeline network is available in the relative vicinity of the production and consumption site. If not, the time and capital required to extend a pipeline network to a remote production site can be cost prohibitive. Further, environmental and safety risks associated with the pipeline may deter the extension of the pipeline and its operation.

Another solution is to store the natural gas as compressed natural gas (CNG). Compressed natural gas is made by first treating raw natural gas to remove natural gas liquids (NGLs) and impurities such as acid gases, primarily carbon dioxide and hydrogen sulphide, and then compressing it in containers at high pressures (2900-3600 psi) into the dense phase for the specific treated raw natural gas composition. CNG is conventionally compressed to less than 1% of the volume it occupies at standard atmospheric pressure.

Another solution is to cryogenically convert raw natural gas to liquefied natural gas (LNG) for storage and transportation by truck, train or ship. Conventionally, the production of LNG involves pre-treating the raw natural gas to remove impurities such as nitrogen, water vapour, carbon dioxide, hydrogen sulphide, n-butane, neo-pentane, n-pentane, n-hexane, benzene, and cyclohexane, which would otherwise freeze, and mercury, which would amalgamate with the metal processing equipment. The treated natural gas is then condensed from a gaseous to an energy-dense liquid state by cooling the gas to approximately −160° C. at near atmospheric pressure. Although the energy density of LNG is greater than that of CNG, the production of LNG production is energy and capital-intensive and requires expensive specially-designed LNG carriers to maintain cryogenic conditions during transport, and expensive specially designed re-gasification facilities at the offloading point.

Crude oil is often produced with dissolved raw natural gas. Conventionally, the associated natural gas is separated from the crude oil at the production site or central processing facility and processed separately. The associated gas may be flared, consumed as fuel, re-injected into the reservoir, processed further into sales gas by removing impurities (such as $H_2S$ and $CO_2$) and NGLs, depending on available markets, economics, environmental considerations, and other factors. The crude oil may be treated to remove free-water, salts, and other impurities as required to meet specifications (such as BS&W, and vapour pressure) prior to transport by pipeline, truck, rail, or ship to markets for further processing into refined products.

In both cases of natural gas production and crude oil production, there is a need to reduce equipment needs and capital costs at production sites for loading storage and transport vessels.

Accordingly, there remains a need in the art for a method of storing, transporting, and offloading to market raw natural gas or crude oil and associated natural gas that is energy efficient, economical and practical to implement.

SUMMARY OF THE INVENTION

Embodiments of the present invention seek to conserve the energy of the reservoir pressure and use it to load crude oil or raw natural gas into a storage vessel, for transport to an unloading site. In either case of compressed gas or compressed oil, the methods of the present invention are intended to result in reduced capital and operating costs by avoiding conventional processing techniques involved with CNG or crude oil production.

In a compressed gas method, the potential energy of raw natural gas is used internally within the process during dehydration, loading, and offloading stages. The method differs from conventional CNG processing in that there are no steps for removing natural gas liquids (NGLs) or impurities such as acid gases prior to compression. Therefore, the method may be applied to raw natural gas as it is received from the wellhead, and can be used for sour gas and natural gas rich in NGLs, without the need to remove acid gases, or separate NGLs from the gas prior to storage. In one embodiment, the method permits a portion of the dehydrated raw natural gas produced at an intermediate stage of the process to be treated, captured and stored as compressed natural gas, which can be used as fuel gas to power equipment associated with process or to transport the stored raw natural gas or crude oil and associated natural gas.

In a compressed oil method, if the reservoir pressure allows crude oil available at the inlet at or near pressures above the bubble point, the potential energy of the crude oil and dissolved natural gas is conserved and the natural pressure of the reservoir may be used to load a storage and transport vessel, without processing to separate and treat the gas.

A method of the present invention may be implemented at remote production sites, whether situated in an onshore or offshore environment, allowing for storage and transport to a centralized processing facility, where the product may then be further processed to separate raw natural gas, and remove NGLs and impurities such as acid gases.

Therefore, in one aspect, the invention comprises a method for processing raw natural gas for storage and transport in a storage vessel at a storage pressure greater than the raw natural gas dense phase pressure, said method comprising the steps of:

(a) receiving the raw natural gas in a flow path at an inlet pressure, wherein the inlet pressure is greater than the storage pressure, or if the inlet pressure is not greater than the storage pressure, compressing the natural gas to a pressure greater than the storage pressure;

(b) if necessary, dehydrating the raw natural gas within the flow path to produce dehydrated raw natural gas;

(c) continuously releasing the dehydrated raw natural gas from the flow path at a release pressure and a release temperature into a storage vessel until the pressure of the dehydrated natural gas in the storage vessel reaches the storage pressure;

wherein the solidification or precipitation of any impurities in the raw natural gas in the storage vessel is limited or prevented by continuously controlling the release pressure or the release temperature, or both the release pressure and temperature.

In another aspect, the invention may comprise a method of processing crude oil having dissolved raw natural gas for storage and transport in a storage vessel at a storage pressure greater than the bubble point pressure, said method comprising the steps of:

(a) receiving the crude oil in a flow path at an inlet pressure, wherein the inlet pressure is greater than the storage pressure, or if the inlet pressure is not greater than the storage pressure, pumping the crude oil to a pressure greater than the storage pressure;

(b) loading the crude oil into the storage vessel until the crude oil reaches the storage pressure, without separating any dissolved raw natural gas from the crude oil.

In one embodiment, the method further comprises the step of separating raw natural gas from the crude oil, compressing or maintaining the pressure of the raw natural gas to at least the storage pressure, dehydrating the raw natural gas, and recombining the dehydrated raw natural gas with the crude oil prior to loading into the storage vessel, wherein the solidification or precipitation of any impurities in the raw natural gas is limited or prevented by continuously controlling the release pressure or the release temperature, or both the release pressure and temperature of the dehydrated raw natural gas.

BRIEF DESCRIPTION OF THE DRAWINGS

The invention will now be described by way of exemplary embodiments with reference to the accompanying simplified, diagrammatic, not-to-scale drawings:

FIG. 3 represents the case where the natural gas reservoir provides the energy to load the storage and transport vessel, and the energy is conserved during transport and then utilized during off-loading as much as possible

DETAILED DESCRIPTION OF PREFERRED EMBODIMENTS

Figure 1:
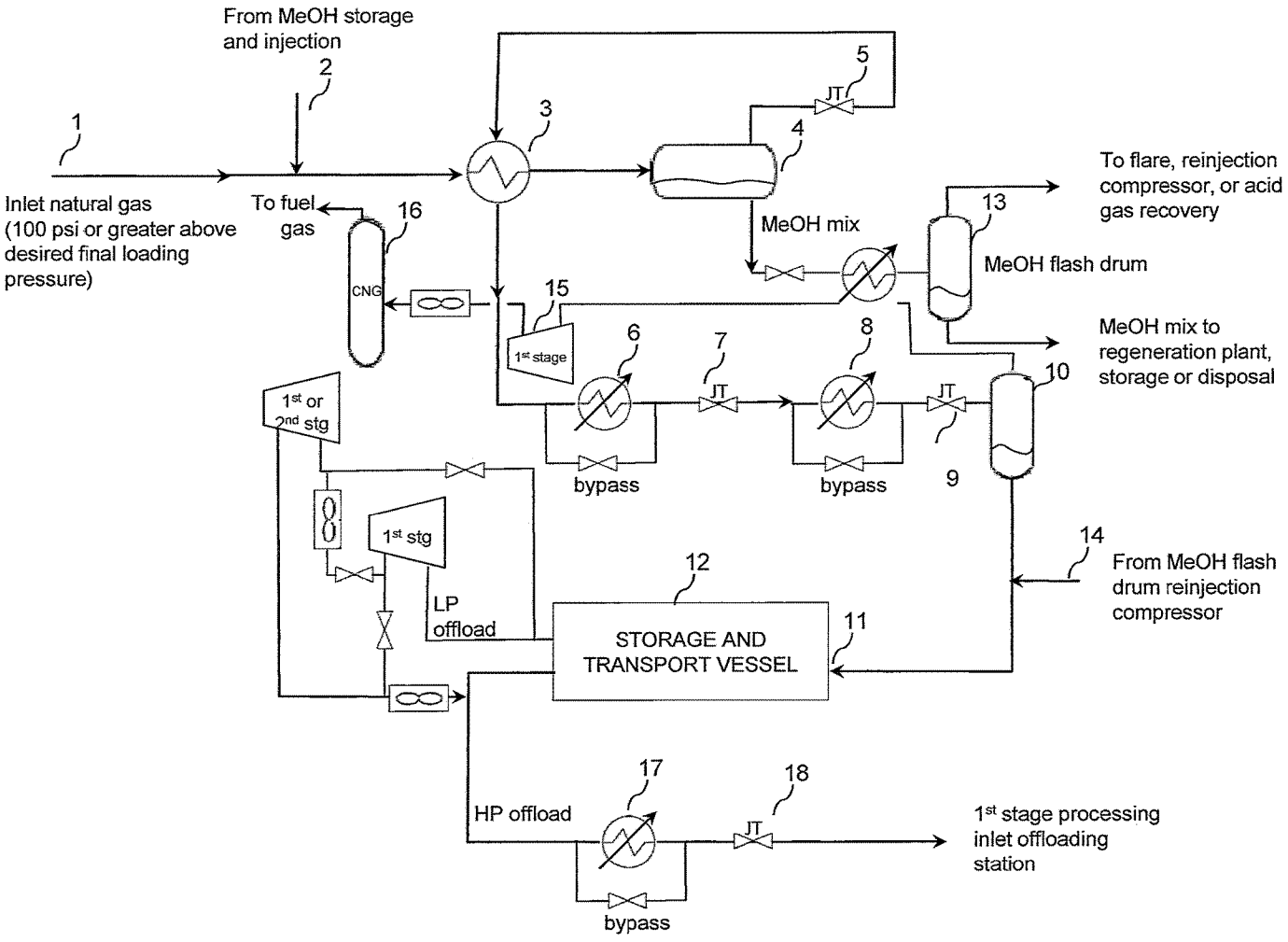
FIG. 1 is a process diagram showing one embodiment of a method of the present invention.

When describing the present invention, all terms not defined herein have their common art-recognized meanings. To the extent that the following description is of specific embodiments or particular uses of the invention, it is intended to be illustrative only, and not limiting of the claimed invention. The following description is intended to cover all alternatives, modifications and equivalents that are included in the spirit and scope of the invention, as defined in the appended claims.

As used herein, the term "bubble point" in relation to crude oil at a particular temperature, refers to the pressure at which natural gas dissolved in the crude oil first begins to evolve as a vapour from the crude oil as the pressure is decreased.

As used herein, the term "crude oil" means generally any synthetic or naturally occurring liquid mixture of hydrocarbon compounds and any impurities.

As used herein, the term "compressed raw natural gas" or "CRNG" means natural gas that has not been treated to pipeline quality specifications or otherwise treated to remove impurities, and has been compressed to high pressure into the dense phase for the gas.

As used herein, the term "dense phase" as it relates to natural gas, raw, treated or otherwise, means the state of natural gas resulting from its compression above its cricodenbar (the maximum pressure above which the natural gas cannot be formed into the gas phase, regardless of temperature), at a temperature within a range defined by approximately its critical temperature (the temperature corresponding to the critical point, being the combination of pressure and temperature at which the intensive properties of the gas and liquid phases of the matter are equal) and approximately its cricondentherm (the maximum temperature above which the natural gas cannot be formed into the liquid phase, regardless of pressure). In the dense phase, natural gas has a viscosity similar to that of the gas phase, but can have a density closer to that of the liquid phase.

As used herein, the term "impurity", as used in the context of crude oil or natural gas, means any non-hydrocarbon component such as nitrogen, carbon dioxide, hydrogen sulphide, metals such as mercury, nitrogen, water, and certain hydrocarbons which are not typically present in treated pipeline quality natural gas, including natural gas liquids such as n-butane, n-pentane, n-pentane, n-hexane, benzene and cyclohexane.

As used herein, the term "JT valve" means a gas valve adapted to allow the adiabatic expansion of gas in accordance with the Joule-Thompson effect. JT valves are well known in the art, and are commercially available.

As used herein, the term "raw natural gas" means any mixture of hydrocarbon gases, natural gas liquids, and any impurities, and may include gases such as methane, ethane, propane, butane, pentane and C6+ gases and liquids. Typically, raw natural gas is as it is produced from a natural gas reservoir, without treatment or processing. As used herein "natural gas" means either raw natural gas or natural gas that has been treated to remove impurities. As used herein, the term "dehydrated natural gas" means raw or treated natural gas substantially free of any water.

In one aspect, the present invention provides a method for storing raw natural gas in a storage vessel at a storage pressure equal to or greater than the dense phase pressure of the natural gas (the compressed raw gas method).

In a second aspect, the present invention provides a method for storing crude oil and associated natural gas in a storage vessel at a storage pressure equal to or greater than the bubble point of the crude oil (the compressed oil method).

Generally speaking, embodiments of both the compressed raw gas method and the compressed oil method comprise a receiving stage, a dehydration stage, and a loading stage. The compressed raw gas or compressed oil may then be transported in storage and transport vessel, and offloaded at a different site. Accordingly, stages for both methods may be described together sequentially with any differences for the two methods being noted, by reference to the exemplary embodiments depicted in FIG. 1 (compressed raw gas method) and FIG. 2 (compressed oil method).

Each of the methods uses a flow path defined by elements (1) through (11) in the compressed gas method, and by elements (101) to (117) in the compressed oil method. As well, each of the methods uses a storage and transport vessel defined by element (12) in the compressed gas method, and by element (118) in the compressed oil method. In some embodiments, the flow path may extend downstream of the storage vessel (12, 118) as further defined by elements (17) to (18) in the compressed gas method, and by elements (128, 129) in the compressed oil method.

In the compressed gas method, the flow path receives natural gas at point (1). The flow path may receive the natural gas from an onshore or offshore natural gas producing reservoir, which may have a natural reservoir pressure greater than the storage pressure, as is contemplated in FIG. 1. In applications where the natural gas inlet pressure is below the storage pressure, the natural gas can be compressed to a pressure greater than the intended storage pressure using conventional means including, for example, compressors.

If the water content of the raw natural gas is too high, the formation of gas hydrates may be problematic. Therefore, in one embodiment, the raw natural gas is dehydrated. The dehydration of the compressed raw natural gas may be effected using any conventional method. In one embodiment, the dehydration is effected by injecting methanol into the natural gas at a point (2) in the flow path. The amount of methanol injected into the natural gas is selected to produce a natural gas-methanol mixture with a suppressed hydrate point temperature for water. Injecting methanol at a rate of approximately 2 Bbl/MMscf is typically sufficient to suppress the hydrate point temperature for water to approximately −40° C. The suppressed hydrate point temperature for water can be selected according to specified storage requirements. Methanol is suitable for suppressing the hydrate point temperature for water to about −100° C. The resulting natural gas-methanol mixture is then cooled to a temperature which is low enough to condense methanol and water, but still above the suppressed hydrate temperature, by any conventional means, such as by passing it through a heat exchanger (3). The liquid methanol-water mixture is then separated from the natural gas using any conventional method. For example, the methanol-water mixture may be separated from the natural gas using a two-phase separator (4). The separated and dehydrated natural gas is then further cooled, for example, by passing it through a JT valve (5). The cooled natural gas may then be used to cool the incoming natural gas-methanol mixture by passing the cooled natural gas back through the heat exchanger (3).

In one embodiment, the condensed water-methanol mixture may include lighter gaseous components of the natural gas such as methane, nitrogen, carbon dioxide, or hydrogen sulphide, which may be separated as a vapour phase using any conventional method, such as by using a flash drum (13). In one embodiment, methanol may be regenerated from the separated water-methanol mix and may be re-used to dehydrate additional natural gas as it is received within the flow path by re-injecting the regenerated methanol at point (2) of the flow path after the water-methanol has been sufficiently purified and regenerated for re-use. In one embodiment any light vapour components of the natural gas such as methane, nitrogen, carbon dioxide, or hydrogen sulphide that flash out as a vapour phase in the MeOH flash drum, may be re-injected after being compressed in a flash drum overhead compressor (not shown) and released at point (14) of the flow path for release into the storage vessel (12).

Once dehydrated, the pressurized natural gas is then directed to the storage vessel (12). At the beginning of the loading stage, the contents of the storage vessel (12) will be at a certain starting temperature and a starting pressure considerably lower than the pressure of the dehydrated natural gas in the flow path. For example, the starting pressure in the storage vessel (12) may be equivalent to about one standard atmosphere. Accordingly, in order to prevent an uncontrolled release of dehydrated natural gas into the storage vessel (12), it is necessary to choke the pressure of the dehydrated natural gas by, for example, passing the dehydrated natural gas through JT valves (7 and 9). As the pressure within the storage vessel (12) increases, the required degree of choking will decrease.

As a consequence of choking the pressure of the dehydrated raw natural gas, the temperature of the natural gas will tend to decrease. If the temperature decreases sufficiently, the resulting combination of pressure and temperature in the storage vessel may result in the solidification of impurities, such as carbon dioxide, hydrogen sulphide, n-pentane, benzene, and cyclohexane of the dehydrated raw natural gas released into the storage vessel (12). In order to prevent the solidification of impurities, it may be necessary to control the temperature of the dehydrated natural gas within the flow path. This may be effected by any conventional means including, for example, passing the dehydrated raw natural gas through a heater such as a glycol or hot oil bath, or other heat medium heaters (6 and 8) in series with the JT valves (7 and 9). As the pressure within the storage vessel (12; 118) increases, and the required degree of choking decreases, so too will the required degree of heating decrease.

The object of loading stage is to fill the storage vessel (12) with natural gas in the dense phase. This is achieved by continuously releasing the dehydrated natural gas at point (11) of the flow path into the storage vessel (12) until the pressure of the dehydrated natural gas in the storage vessel (12) reaches the desired storage pressure, which is at least the dense phase pressure of the natural gas. At the initial part of the loading stage, the pressure in the storage vessel (12) may be relatively low. Thus, the dehydrated natural gas released into the storage vessel (12), may initially be in a two-phase liquid-gas state. Accordingly, where the storage vessel (12) has a plurality of compartments, it may be necessary to use a manifold piping system to distribute the two-phase mixture equally to be simultaneously released into multiple compartments of the storage vessel (12), and pressurized above the cricodenbar for the compressed raw gas method.

Figure 2:
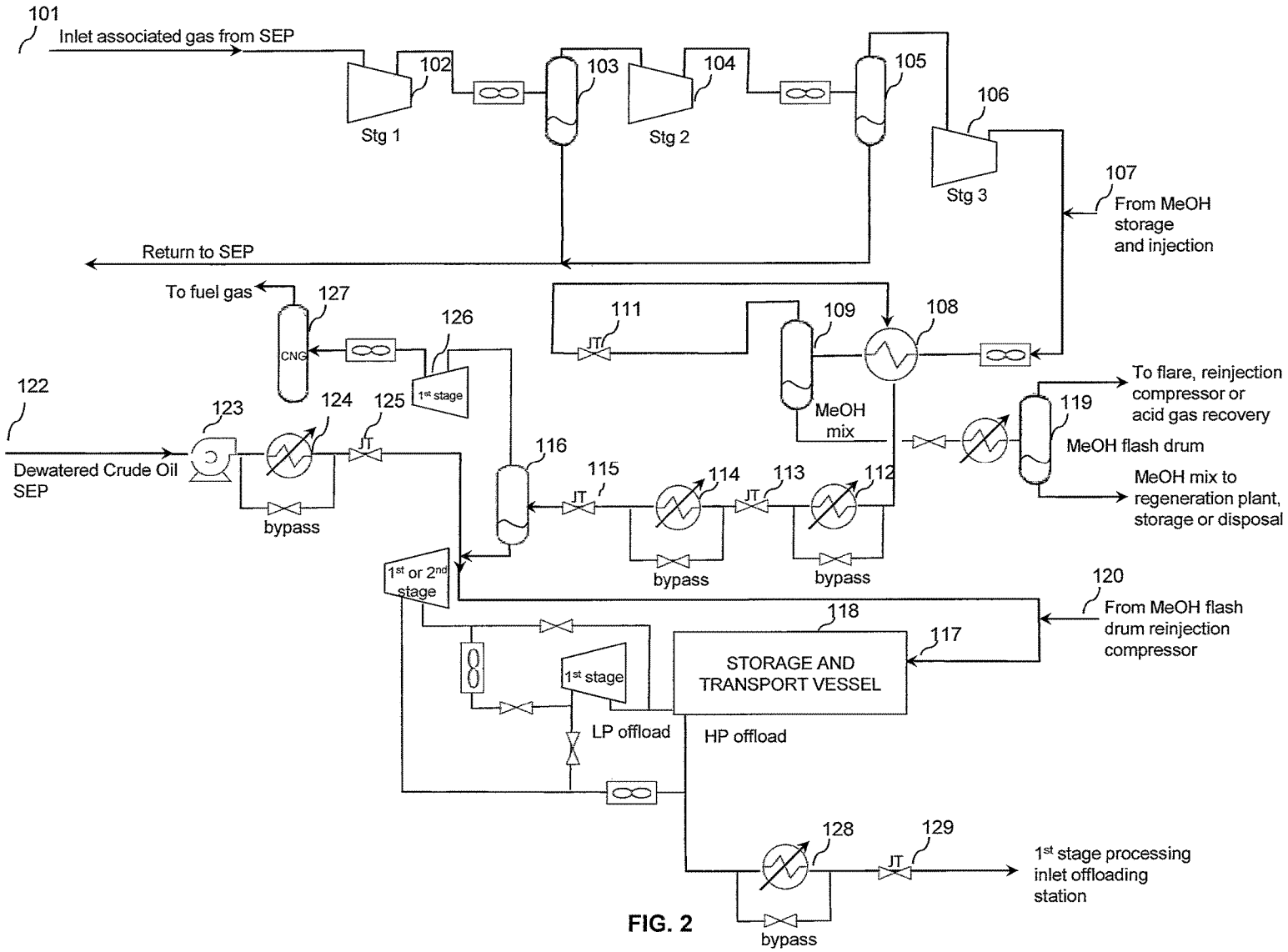
FIG. 2 is a process diagram showing an alternative embodiment of a method of the present invention.

The compressed oil method, shown schematically in FIG. 2, may be used where the produced hydrocarbons at the wellhead substantially comprises crude oil. Generally, when the oil and any associated natural gas are at a pressure below the bubble point they are initially separated, pressurized separately, and recombined after the natural gas has been dehydrated.

In this case, the oil and natural gas are first separated in an initial separator. The crude oil may be dewatered using conventional methods. The flow path receives dewatered crude oil at point (122) and the separated natural gas at point (101). The flow path may receive the crude oil and natural gas from an onshore or offshore oil and natural gas producing reservoir. If the gas inlet (101) pressure is lower than the bubble point, it will be necessary to pressurize the raw associated natural gas, for example by using multiple compressors. In one embodiment, three compression stages (102, 104, 106) are provided, and after the first two compressor stages, any liquids which form, which may be heavier hydrocarbons, are separated in a separator (103, 105) and returned to the initial separator, to be mixed with the crude oil.

The natural gas from the initial separator, after pressurization, is then dehydrated, by any conventional method. In one embodiment, the dehydration is effected by injecting methanol into the natural gas at a point (107) in the flow path, in a process similar to that described above with respect to the compressed gas method. The resulting natural gas-methanol mixture is cooled to a temperature above the suppressed hydrate temperature by any conventional means, such as by passing it through a heat exchanger (108), to condense a methanol-water mixture. The condensed methanol-water mixture is then separated from the natural gas using any conventional method. For example, the methanol-water mixture is separated from the natural gas using a two-phase separator (109). The separated natural gas is then further cooled, for example, by passing it through a JT valve (111). The cooled natural gas may then be used to cool the incoming natural gas-methanol mixture by passing the cooled natural gas back through the heat exchanger (108).

The dehydrated, pressurized natural gas may then be introduced into the flow of crude oil through the bottom of the conventional two phase separator (116). If the gas pressure is significantly higher than the pressure in the crude oil flow and in the storage vessel (118), the pressure may be choked downward with a JT valve or valves (113, 115). As a consequence of choking the pressure of the dehydrated raw natural gas, the temperature of the natural gas will tend to decrease. If the temperature decreases sufficiently, the resulting combination of pressure and temperature may result in the solidification of impurities, such as carbon dioxide, hydrogen sulphide, neo-pentane, benzene, and cyclohexane of the dehydrated raw natural gas. In order to prevent the solidification of impurities, it may be necessary to control the temperature of the dehydrated natural gas within the flow path. This may be effected by any conventional means including, for example, passing the dehydrated raw natural gas through a glycol or hot oil bath, or other heat medium heaters (112, 114) in series with the JT valves (113 and 115). As the pressure within the storage vessel (118) increases, and the required degree of choking decreases, so too will the required degree of heating decrease.

In one embodiment, the water-methanol mixture may be separated from the lighter gaseous components of the natural gas such as methane, nitrogen, carbon dioxide, or hydrogen sulphide that flash out as a vapour phase using any conventional method. For example, the water-methanol mixture may be passed through a flash drum (119). In one embodiment, the separated water-methanol mix may be re-used to dehydrate additional natural gas as it is received within the flow path by re-injecting the methanol at point (107) of the flow path after the methanol has been sufficiently purified and regenerated for re-use. In one embodiment any light vapour components of the natural gas such as methane, nitrogen, carbon dioxide, or hydrogen sulphide that flash out as a vapour phase in the MeOH flash drum, may be re-injected after being compressed in a flash drum overhead compressor (not shown) and released at point (120) of the flow path for release into the storage vessel (118).

If the pressure of the dewatered crude oil at inlet (122) is lower than the bubble point and the desired storage pressure, the dewatered crude oil is pressurized by pump (123). If the pressure of the crude oil is greater than the bubble point and the desired storage pressure, the dewatered crude oil and dissolved gas enters the flow path at point (122) without the need for pumping. In some applications, such as with some offshore reservoirs, where the crude oil inlet pressure is sufficiently high, the associated natural gas may already be fully dissolved in the crude oil and can flow directly to the loading phase entering at point (122) and bypass pump (123) without the need to separate the crude oil from the associated natural gas and dehydrate the associated gas.

Generally, no further treatment of the crude oil is required, except that heating (124) and pressure control (125) may be employed during the loading stage. The object of loading stage is to fill the storage vessel with crude oil and dissolved associated natural gas. This is achieved by continuously releasing the dewatered crude oil with dissolved natural gas at point (117) of the flow path into the storage vessel (118) until the pressure of the crude oil in the storage vessel (118) is above the bubble point of the crude oil and reaches the desired storage pressure, and continues until the storage vessel is filled with crude oil.

In the case of the compressed oil method, at the initial part of the loading stage, the pressure in the storage vessel (118) may be relatively low, below the bubble point. Thus, natural gas may evolve from the crude oil, resulting in a two-phase liquid-gas state entering the storage vessel (118). Accordingly, where the storage vessel (118) has a plurality of compartments, it may be necessary to use a manifold piping system to distribute the two-phase mixture equally to be simultaneously released into multiple compartments of the storage vessel (118), and pressurized above the bubble point for the compressed crude oil.

In one embodiment, in the course of the loading stage of either the compressed raw gas scheme or the compressed oil scheme, a portion of the dehydrated natural gas stream can be diverted and stored as compressed natural gas (CNG), which can be used, for example, as a fuel. For example, the dehydrated natural gas can be passed through a JT valve (9, 115) through pressure range of approximately 500 to 700 psig and a two-phase separator (10; 116) to divert a portion of the natural gas as a treated gas (heavy liquid hydrocarbons removed), and a single stage compressor (15; 126) used to pressurize a compressed natural gas vessel (16; 127). The take off point for the compressed natural gas is preferably upstream of any MeOH flash drum vapour reinjection point (14; 120) in the flow path to minimize the amount of carbon dioxide or hydrogen sulphide in the treated compressed natural gas fuel. Depending on the composition of the raw natural gas fed into the system, the treated compressed natural gas may require additional treating before use. The compressed natural gas may used as a fuel gas for the equipment used to implement the method, or for the transportation of the storage vessel (12; 118).

Once the storage vessel (12; 118) has been pressurized with raw natural gas in the dense phase in the case of the compressed gas method, or with crude oil and dissolved raw natural gas in the case of the compressed oil method, the storage vessel (12; 118) may be conveyed by conventional vehicles such as truck, train or ship. After the storage vessel (12; 118) has been transported to the offloading site, the potential energy of the dehydrated natural gas in the dense phase or the associated natural gas dissolved in the crude oil can be utilized to unload the natural gas or crude oil, as the case may be, from the storage vessel (12; 118) without the need for pumping, or at least with reduced pumping requirements. A heater (17; 128) and JT valve (18; 129) may be utilized to control the delivery pressure and temperature specified by the offloading site's first stage processing inlet. Compression is utilized for the final offloading to discharge the remaining raw natural gas for the compressed gas method or the associated gas for the compressed oil method that remains in the storage vessels below the offloading site receiving pressure to the desired final pressure (heel pressure in the storage vessel).

Example of Compressed Raw Gas Method

The following example is intended to illustrate an exemplary embodiment of the present invention, and not to limit the claimed invention in any manner.

Figure 3:
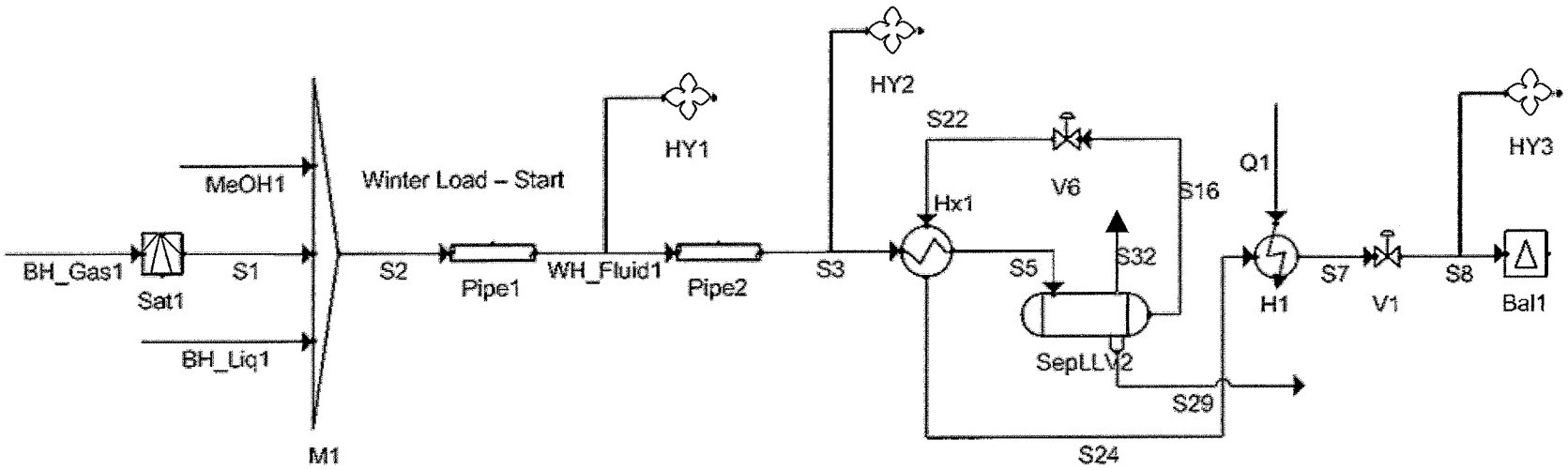
FIG. 3 is a process diagram showing a further alternative embodiment of a method of the present invention.

FIG. 3 depicts a process diagram for an example of the compressed gas method. Table 1 below indicates the properties of the natural gas and methanol as they progress through the flow path as mathematically simulated using the process simulation software, VMGSim™ (Virtual Material Group, Inc.). The mathematical simulation assumes that the pressure in the storage vessel (Bal1) starts at 500 psig before any loading with natural gas.

Referring to FIG. 3 and Table 1 certain aspects of the method are noted below.

The natural gas is supplied into the flow path from a natural reservoir with a bottom hole at 2,700 m below the well head. The natural gas and the NGL at bottom hole location (BH_Gas1 and BH_Liq1) have a temperature of 176.0° F. and a pressure of 4061.1 psia. The amount of NGL is equivalent to 40 Bbl/MMscf at 1000 psig.

It is assumed that by the time the natural gas has reached the well head location (WH_Fluid1), the natural gas has decreased in temperature to 103.5° F., due to the cooling effect of permafrost on the well bore, and decreased in pressure to 3288.6 psia.

Pipe 2 travels above ground and assumed to be under winter conditions at a northern latitude. By the time the natural gas has reached the end of pipe 2 in segment (S3), ambient winter conditions have chilled the natural gas to a temperature of −39.8° F. and further decreased the pressure to 3274.6 psia. Accordingly, in this example, the heat exchanger (Hx1) and the JT valve (V6) are not required to further cool the natural gas, but may be used to cool the natural gas in warmer ambient conditions.

Before entering the two-phase separator (SepLLV2), the mole fraction of water in the natural gas is 0.2828% in segment (S5). After separation in the two-phase separator (SepLLV2), the mole fraction of water in the natural gas is essentially nil in segment (S16), reflecting the dehydration of the natural gas.

The heater (H1) provides heat to the natural gas at a rate Q1 equal to 320953.3 Btu/hr to raise the temperature of the natural gas from −39.9° F. in segment (S24) to 90.0° F. in segment (S7).

At the start of the loading stage, valve (V1) chokes the pressure of the natural gas in the flow path to decrease the pressure of the natural gas from 3255.0 psia in segment (S7) to 515.0 psia in segment (S8), which represents the storage and transport vessel. This results in the temperature of the natural gas decreasing from 90.0° F. to −4.6° F. As a result, the natural gas in segment (S8) is initially in a two-phase, gas-liquid state, having a vapour fraction of 0.9062.

As the storage vessel (Bal1) is pressurized, however, the amount of choking required decreases. At the end of the loading stage, valve (V1) chokes the pressure of the natural gas from 3255.0 psia in segment (S7) to 2465.0 psia in segment (S8), which is the storage pressure. This results in the temperature of the natural gas decreasing from 90.0° F. to 77.6° F. The natural gas in segment (S8) is now in the dense phase, having zero vapour fraction.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

TABLE 1

| In: Connected To<br>Out: Connected To | BH_Gas1/<br>Sat1.MainFeed | BH_Liq1/<br>M1.In0 | MeOH1/<br>M1.In2 | S1/<br>Sat1.Saturated/<br>M1.In1 | S2/<br>M1.Out/<br>Pipe1.In | WH_Fluid1/<br>Pipe1.Out/<br>Pipe2.In |
|---|---|---|---|---|---|---|
| VapFrac | 0.0000 | 0.0000 | 0.0000 | 0.0000 | 0.0000 | 0.0000 |
| T [F.] | 176.0 | 176.0 | 26.0 | 176.0 | 170.0 | 103.5 |
| P [psia] | 4061.1 | 4061.1 | 4061.1 | 4061.1 | 4061.1 | 3288.6 |
| MoleFlow [lbmole/h] | 439.197 | 24.813 | 3.183 | 440.116 | 468.113 | 468.113 |
| MassFlow [lb/h] | 8757.301 | 1539.849 | 102.000 | 8773.870 | 10415.719 | 10415.719 |
| StdLiqVolumeFlow [bbl/day] | 1761.909 | 180.000 | 8.777 | 1763.045 | 1951.822 | 1951.822 |
| StdGasVolumeFlow [MMSCFD] | 4.000 | 0.226 | 0.029 | 4.008 | 4.263 | 4.263 |
| Energy [Btu/hr] | 1727785.01 | 87725.44 | 39742.32 | 1730903.86 | 1778886.97 | 1298142.05 |
| MolecularWeight | 19.9394 | 62.0579 | 32.0419 | 19.9353 | 22.2505 | 22.2505 |
| MassDensity [lb/ft3] | 13.1833 | 36.0499 | 51.1099 | 13.1877 | 15.4574 | 16.2873 |
| CpMass [Btu/lb-F.] | 0.7512 | 0.5967 | 0.6812 | 0.7512 | 0.7526 | 0.7968 |
| ThermalConductivity [Btu/hr-ft-F.] | 0.0448 | 0.0616 | 0.1245 | 0.0449 | 0.0448 | 0.0439 |
| Viscosity [cp] | 0.0228 | 0.1452 | 0.8711 | 0.0229 | 0.0262 | 0.0272 |
| Mole Fraction | | | | | | |
| NITROGEN | 0.004895 | 0.000200 | 0.000000 | 0.004885 | 0.004604 | 0.004604 |
| CARBON DIOXIDE | 0.021580 | 0.013000 | 0.000000 | 0.021535 | 0.020936 | 0.020936 |
| METHANE | 0.836130 | 0.273400 | 0.000000 | 0.834383 | 0.798973 | 0.798973 |
| ETHANE | 0.079327 | 0.098300 | 0.000000 | 0.079161 | 0.079637 | 0.079637 |
| PROPANE | 0.035767 | 0.115300 | 0.000000 | 0.035692 | 0.039669 | 0.039669 |
| ISOBUTANE | 0.005095 | 0.028200 | 0.000000 | 0.005085 | 0.006275 | 0.006275 |
| n-BUTANE | 0.008592 | 0.071100 | 0.000000 | 0.008574 | 0.011830 | 0.011830 |
| ISOPENTANE | 0.001998 | 0.027600 | 0.000000 | 0.001994 | 0.003338 | 0.003338 |
| n-PENTANE | 0.001798 | 0.031000 | 0.000000 | 0.001795 | 0.003330 | 0.003330 |
| n-HEXANE | 0.001199 | 0.000000 | 0.000000 | 0.001196 | 0.001125 | 0.001125 |
| n-HEPTANE | 0.001499 | 0.000000 | 0.000000 | 0.001495 | 0.001406 | 0.001406 |

TABLE 1-continued

| | | | | | | |
|---|---|---|---|---|---|---|
| n-OCTANE | 0.001199 | 0.341900 | 0.000000 | 0.001196 | 0.019248 | 0.019248 |
| WATER | 0.000920 | 0.000000 | 0.000000 | 0.003008 | 0.002828 | 0.002828 |
| ETHYLENE GLYCOL | 0.000000 | 0.000000 | 0.000000 | 0.000000 | 0.000000 | 0.000000 |
| METHANOL | 0.000000 | 0.000000 | 1.000000 | 0.000000 | 0.006800 | 0.006800 |

| In: Connected To<br>Out: Connected To | S3/<br>Pipe2.Out/<br>Hx1.InTube | S5/<br>Hx1.OutTube/<br>SepLLV2.In | S29/<br>SepLLV2.Liq1 | S32/<br>SepLLV2.Vap | S16/<br>SepLLV2.Liq0/<br>V6.In | S22/<br>V6.Out/<br>Hx1.InShell |
|---|---|---|---|---|---|---|
| VapFrac | 0.0000 | 0.0000 | 0.0000 | 1.0000 | 0.0000 | 0.0000 |
| T [F.] | −39.8 | −39.9 | −39.9 | −39.9 | −39.9 | −39.9 |
| P [psia] | 3274.6 | 3269.6 | 3269.6 | 3269.6 | 3269.6 | 3265.0 |
| MoleFlow [lbmole/h] | 468.113 | 468.113 | 3.655 | 0.000 | 464.458 | 464.458 |
| MassFlow [lb/h] | 10415.719 | 10415.719 | 98.128 | 0.000 | 10317.591 | 10317.591 |
| StdLiqVolumeFlow [bbl/day] | 1951.822 | 1951.822 | 8.104 | 0.000 | 1943.718 | 1943.718 |
| StdGasVolumeFlow [MMSCFD] | 4.263 | 4.263 | 0.033 | 0.000 | 4.230 | 4.230 |
| Energy [Btu/hr] | 96162.37 | 95786.21 | −53568.30 | 0.00 | 149354.51 | 149354.51 |
| MolecularWeight | 22.2505 | 22.2505 | 26.8504 | 22.2133 | 22.2143 | 22.2143 |
| MassDensity [lb/ft3] | 24.4705 | 24.4671 | 54.5305 | 24.3386 | 24.3395 | 24.3340 |
| CpMass [Btu/lb-F.] | 0.7479 | 0.7481 | 0.7662 | 0.7479 | 0.7479 | 0.7482 |
| ThermalConductivity [Btu/hr-ft-F.] | 0.0595 | 0.0595 | 0.1537 | 0.0586 | 0.0586 | 0.0586 |
| Viscosity [cp] | 0.0634 | 0.0634 | 7.9519 | 0.0588 | 0.0588 | 0.0588 |
| Mole Fraction | | | | | | |
| NITROGEN | 0.004604 | 0.004604 | 0.000213 | 0.004639 | 0.004638 | 0.004638 |
| CARBON DIOXIDE | 0.020936 | 0.020936 | 0.001584 | 0.021088 | 0.021088 | 0.021088 |
| METHANE | 0.798973 | 0.798973 | 0.008277 | 0.805211 | 0.805194 | 0.805194 |
| ETHANE | 0.079637 | 0.079637 | 0.000450 | 0.080257 | 0.080260 | 0.080260 |
| PROPANE | 0.039669 | 0.039669 | 0.000055 | 0.039977 | 0.039981 | 0.039981 |
| ISOBUTANE | 0.006275 | 0.006275 | 0.000001 | 0.006324 | 0.006325 | 0.006325 |
| n-BUTANE | 0.011830 | 0.011830 | 0.000003 | 0.011922 | 0.011923 | 0.011923 |
| ISOPENTANE | 0.003338 | 0.003338 | 0.000000 | 0.003363 | 0.003364 | 0.003364 |
| n-PENTANE | 0.003330 | 0.003330 | 0.000000 | 0.003356 | 0.003357 | 0.003357 |
| n-HEXANE | 0.001125 | 0.001125 | 0.000000 | 0.001133 | 0.001134 | 0.001134 |
| n-HEPTANE | 0.001406 | 0.001406 | 0.000000 | 0.001417 | 0.001417 | 0.001417 |
| n-OCTANE | 0.019248 | 0.019248 | 0.000000 | 0.019394 | 0.019399 | 0.019399 |
| WATER | 0.002828 | 0.002828 | 0.361957 | 0.000002 | 0.000002 | 0.000002 |
| ETHYLENE GLYCOL | 0.000000 | 0.000000 | 0.000000 | 0.000000 | 0.000000 | 0.000000 |
| METHANOL | 0.006800 | 0.006800 | 0.627460 | 0.001916 | 0.001917 | 0.001917 |

| In: Connected To<br>Out: Connected To | S24/<br>Hx1.OutShell/<br>H1.In | S7/<br>H1.Out/<br>V1.In | S8 Start/<br>V1.Out/<br>Bal1.In0 | S8 End/<br>V1.Out/<br>Bal1.In0 |
|---|---|---|---|---|
| VapFrac | 0.0000 | 0.0000 | 0.9062 | 0.0000 |
| T [F.] | −39.9 | 90.0 | −4.6 | 77.6 |
| P [psia] | 3260.0 | 3255.0 | 515.0 | 2465.0 |
| MoleFlow [lbmole/h] | 464.458 | 464.458 | 464.458 | 464.458 |
| MassFlow [lb/h] | 10317.591 | 10317.591 | 10317.591 | 10317.591 |
| StdLiqVolumeFlow [bbl/day] | 1943.718 | 1943.718 | 1943.718 | 1943.718 |
| StdGasVolumeFlow [MMSCFD] | 4.230 | 4.230 | 4.230 | 4.230 |
| Energy [Btu/hr] | 149730.67 | 1212470.31 | 1212470.31 | 1212470.31 |
| MolecularWeight | 22.2143 | 22.2143 | 22.2143 | 22.2143 |
| MassDensity [lb/ft3] | 24.3254 | 16.7743 | 3.0702 | 14.6745 |
| CpMass [Btu/lb-F.] | 0.7485 | 0.8029 | 0.5770 | 0.8601 |
| ThermalConductivity [Btu/hr-ft-F.] | 0.0586 | 0.0438 | 0.0304 | 0.0392 |
| Viscosity [cp] | 0.0587 | 0.0276 | 0.0151 | 0.0224 |
| Mole Fraction | | | | |
| NITROGEN | 0.004638 | 0.004638 | 0.004638 | 0.004638 |
| CARBON DIOXIDE | 0.021088 | 0.021088 | 0.021088 | 0.021088 |
| METHANE | 0.805194 | 0.805194 | 0.805194 | 0.805194 |
| ETHANE | 0.080260 | 0.080260 | 0.080260 | 0.080260 |
| PROPANE | 0.039981 | 0.039981 | 0.039981 | 0.039981 |
| ISOBUTANE | 0.006325 | 0.006325 | 0.006325 | 0.006325 |
| n-BUTANE | 0.011923 | 0.011923 | 0.011923 | 0.011923 |
| ISOPENTANE | 0.003364 | 0.003364 | 0.003364 | 0.003364 |
| n-PENTANE | 0.003357 | 0.003357 | 0.003357 | 0.003357 |
| n-HEXANE | 0.001134 | 0.001134 | 0.001134 | 0.001134 |
| n-HEPTANE | 0.001417 | 0.001417 | 0.001417 | 0.001417 |
| n-OCTANE | 0.019399 | 0.019399 | 0.019399 | 0.019399 |
| WATER | 0.000002 | 0.000002 | 0.000002 | 0.000002 |
| ETHYLENE GLYCOL | 0.000000 | 0.000000 | 0.000000 | 0.000000 |
| METHANOL | 0.001917 | 0.001917 | 0.001917 | 0.001917 |

What is claimed is:

1. A method for processing raw natural gas, for storage and transport in a storage vessel at a storage pressure greater than the raw natural gas dense phase pressure, said method comprising the steps of:

(a) receiving the raw natural gas directly from a reservoir and comprising impurities comprising carbon dioxide, hydrogen sulphide, pentane, benzene or cyclohexane in a flow path at an inlet pressure, wherein the inlet pressure is greater than the storage pressure, such that a reduction in pressure from the inlet pressure to the storage pressure would result in temperature reduction resulting in solidification or precipitation of the impurities in the raw natural gas;

(b) injecting methanol into the raw natural gas to prevent formation of hydrates within the flow path, comprising the sub-steps of:

(i) injecting a sufficient amount of methanol into natural gas to produce a natural gas-methanol mixture with a suppressed hydrate temperature for the gas;

(ii) cooling the natural gas-methanol mixture to a temperature above the suppressed hydrate point to condense a liquid methanol-water mixture;

(iii) separating the condensed methanol-water mixture from the natural gas;

(iv) decreasing the pressure of the natural gas under adiabatic conditions to cool the natural gas;

(v) optionally, using the cooled natural gas to cool the methanol-natural gas mixture in sub-step (ii), above, as additional natural gas is received within the flow path;

(vi) separating a gas phase from the condensed water-methanol mixture from step (ii); and (vii) recombining the gas phase with the raw natural gas; and (c) continuously releasing the raw natural gas from the flow path into the storage vessel by choking the pressure of the raw natural gas down to the storage pressure and heating the raw natural gas to limit or prevent the solidification or precipitation of the impurities in the raw natural gas.

2. The method of claim 1, wherein the flow path derives the inlet pressure from a natural reservoir pressure of the raw natural gas, or additional compression, or both.

3. The method of claim 1 wherein the inlet pressure exceeds the storage pressure by 100 psi or greater.

4. The method of claim 1 wherein the suppressed hydrate temperature is between about −60° C. and −20° C.

5. The method of claim 1 further comprising the sub-step of recovering the condensed water-methanol mixture and regenerating the methanol for re-injection into the natural gas in step (b) of claim 1 as additional natural gas is received within the flow path.

6. The method of claim 1 further comprising the steps of:

(a) diverting a portion of the raw natural gas from the flow path; and (b) treating the raw natural gas to be substantially free of any impurities, and storing the diverted natural gas as compressed natural gas.

7. The method of claim 1 further comprising the steps of transporting the storage vessel, and offloading the raw natural gas by releasing the natural gas in the dense phase from the storage vessel into a downstream flow path.

8. The method of claim 7, wherein the temperature or the pressure, or both of the raw natural gas is controlled in the offloading step.

* * * * *